US007824149B2

(12) United States Patent
Brewer

(10) Patent No.: US 7,824,149 B2
(45) Date of Patent: Nov. 2, 2010

(54) TURBINE

(75) Inventor: Christopher Brewer, Lavina, MT (US)

(73) Assignee: Momentum Technologies Corporation, Roundup, MT (US)

( * ) Notice: Subject to any disclaimer, the term of this patent is extended or adjusted under 35 U.S.C. 154(b) by 348 days.

(21) Appl. No.: 11/601,978

(22) Filed: Nov. 20, 2006

(65) Prior Publication Data

US 2007/0116554 A1 May 24, 2007

Related U.S. Application Data

(60) Provisional application No. 60/739,349, filed on Nov. 23, 2005.

(51) Int. Cl.
*F01B 1/00* (2006.01)

(52) U.S. Cl. ..... 415/80; 415/89; 415/90

(58) Field of Classification Search ..... 415/80, 415/88, 90, 89, 910; 416/4
See application file for complete search history.

(56) References Cited

U.S. PATENT DOCUMENTS 509,644 A 11/1893 Bardsley
999,776 A * 8/1911 Gill ..... 415/82
1,061,142 A 5/1913 Tesla
1,200,559 A * 10/1916 Williams ..... 366/220
1,263,325 A 4/1918 Klahn
3,926,534 A * 12/1975 Erickson ..... 415/89
4,674,950 A * 6/1987 Erickson ..... 415/88

* cited by examiner

*Primary Examiner*—Edward Look
*Assistant Examiner*—Dwayne J White
(74) *Attorney, Agent, or Firm*—Husch Blackwell LLP

(57) ABSTRACT

A turbine has a hollow conical rotor sealed by a base end cap. The outer race of a bearing is centered and mounted on the end cap. An intake shaft mounted within the bearing's inner race passes through the race. High-pressure fluid introduced into a passage within the intake shaft passes through a nozzle arm and nozzle mounted on the intake shaft within the interior of the rotor and is directed by the nozzle against the inner surface of the rotor. Friction and adhesion between the fluid and the inner surface transfers kinetic energy to the rotor, causing it to rotate. Fluid is exhausted from the interior of the cone through a passage in an output shaft attached to the apex of the rotor. Mechanical power may be extracted from the rotating output shaft directly, or through pulleys, gears, or other means. The turbine may be enhanced by addition of a cylinder between the base of the cone and the end cap, providing more surface area for energy exchange.

23 Claims, 1 Drawing Sheet

FIG. 1
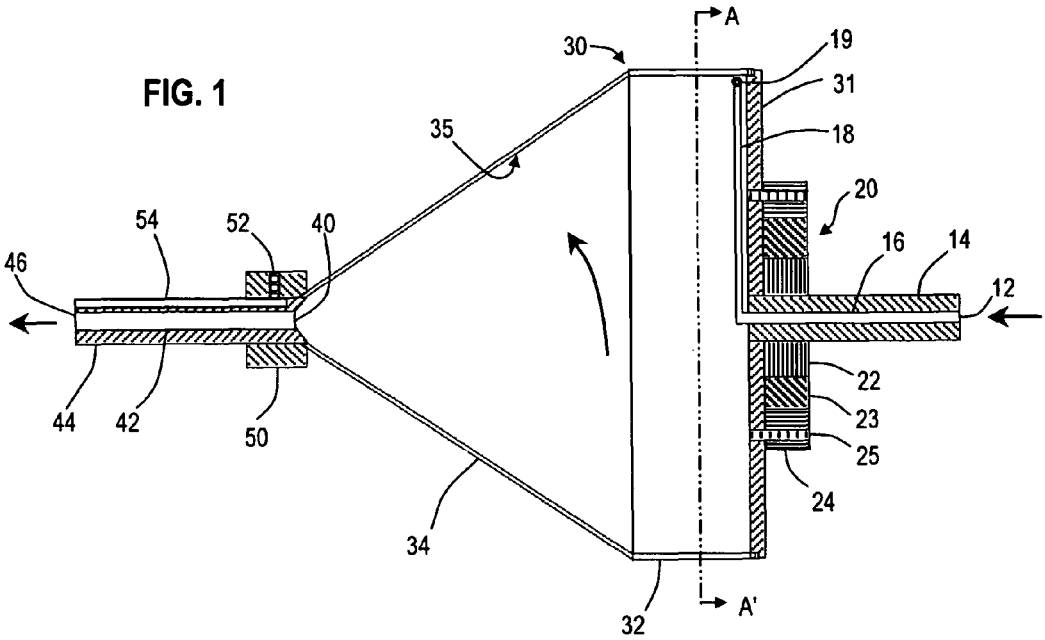
FIG. 2
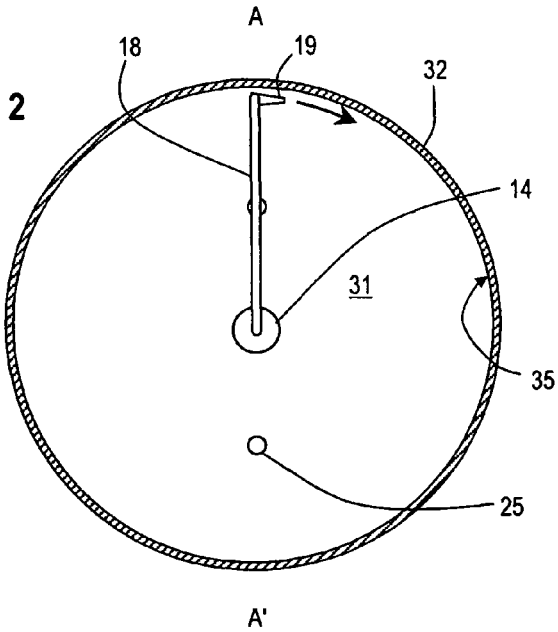
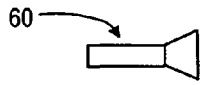
FIG. 3
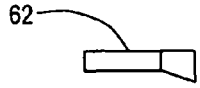
FIG. 4

TURBINE

CROSS-REFERENCE TO RELATED APPLICATION

This application claims priority from provisional patent application Ser. No. 60/739,349, filed Nov. 23, 2005 by the same inventor.

BACKGROUND

A turbine can provide a highly efficient means for converting energy within a moving fluid into torque. The fluid is typically directed against blades that absorb energy from the fluid by deflecting the flow. Blades are mounted radially on a central rotor that rotates in response to energy imparted to each blade by the fluid. Blades may be grouped in stages along the length of a rotor, with the shape of the blades in each stage selected to optimize energy transfer under expected fluid conditions.

Since a turbine usually obtains highest efficiency at high rotational speed, the blades and rotor require precision machining and must be carefully balanced. Blades may expand and warp when heated and are subject to chemical and mechanical damage. Resulting imbalances may destroy a turbine. The rotor in a reaction turbine is often supported by bearings that are subject to extreme temperatures and corrosive agents, also causing turbine failure. The exotic materials and precision manufacturing needed to ensure both maximum efficiency and reliability result in high manufacturing and maintenance costs.

The Tesla turbine was an early attempt to avoid design problems inherent in a turbine utilizing blades. The Tesla turbine instead utilizes of a set of parallel disks mounted radially on a shaft. One or more nozzles direct a moving fluid toward the outer edges of the disks. As the fluid passes between disks, adhesion between the fluid and each disk transfers energy from the fluid to the disks, which in turn apply torque to the shaft. Since the fluid is exhausted from the turbine through ports near the shaft, fluid flowing between disks spirals inward, maximizing contact time and energy transfer.

Although the Tesla turbine is in theory highly efficient, maximum efficiency is achieved when the spacing between disks approximates the thickness of a particular fluid's boundary layer. Since boundary layer thickness varies with fluid pressure and viscosity, each Tesla turbine design must be optimized for a specific range of fluid conditions. Disks must be thin to maximize available surface area and minimize edge turbulence. Disks must be closely spaced to maximize energy absorption from low viscosity fluids. Thin, closely-spaced disks may be subject to warping and damage.

What is needed is a turbine that avoids these shortcomings, is inexpensive to manufacture and maintain, and is able to extract energy from a variety of moving fluids over a wide range of temperature, pressure, viscosity, and chemical conditions without suffering significant damage.

SUMMARY

A simple and versatile turbine may be constructed from a hollow conical rotor, with the base of the cone substantially sealed by an end cap. The outer race of a bearing is centered and mounted on the end cap. An intake shaft is mounted within the bearing's inner race and passes through the race.

An inlet passage within the intake shaft communicates with a nozzle arm. The nozzle arm is mounted within the enclosed space formed by the cone and end cap, typically on the end of and orthogonal to the intake shaft. A nozzle is mounted at the opposite end of the nozzle arm. High-pressure fluid introduced into the inlet passage passes through the nozzle arm and is directed by the nozzle substantially tangentially against the inner surface of the cone. Friction and adhesion between the fluid and the inner surface of the rotor transfers kinetic energy to the rotor, causing it to rotate.

Injected fluid is pressed by centrifugal force against the inner surface of the cone. The fluid spirals to the apex of the cone, with the decreasing radius of the cone maintaining the force of the fluid against the cone. Once fluid reaches the apex of the cone it is exhausted from the interior of the cone through a passage in an output shaft attached to the apex of the cone. Mechanical power may be extracted from the rotating output shaft directly, or through pulleys, gears, or other means. The turbine may be enhanced by addition of a cylinder between the base of the cone and the end cap, providing more surface area for energy exchange.

BRIEF DESCRIPTION OF THE DRAWINGS

FIG. 1 shows a cross-sectional side elevation view of a turbine.

FIG. 2 shows a cross-sectional end elevation view of a turbine.

FIG. 3 shows a plan view of a collector.

FIG. 4 shows a side elevation view of a collector.

DETAILED DESCRIPTION

FIG. 1 shows a cross-sectional side elevation view of a turbine. High pressure fluid enters the system through a high-pressure port 12 and passes into an inlet passage 16 in the center of an intake shaft 14. The inlet passage 16 communicates with a nozzle arm 18 to transmit fluid to a nozzle 19 that converts a high-pressure working fluid to a high-velocity working fluid. Working fluids include but are not limited to water, air, combustion gases, steam, and refrigerant. Fluid escaping the nozzle 19 flows around the inner surface 35 of a rotor 30. The rotor 30 comprises at least an end cap 31 and a cone 34, and may also include a cylinder 32. FIG. 2 shows a cross-sectional end elevation view of a turbine.

Returning to FIG. 1, the nozzle 19 directs the fluid approximately orthogonally to both the nozzle arm 18 and the intake shaft 14 and approximately tangentially to the inner surface 35. The inner surface 35 of the end cap 31 contains the fluid, forcing the fluid toward the cone 34. As the fluid escaping the nozzle 19 flows around the inner surface 35, adhesion and friction between the high-velocity fluid and the inner surface 35 exert drag on the rotor 30. Kinetic energy is transferred from the fluid to the rotor 30, causing rotational acceleration of the rotor 30 with respect to an inner bearing race 22, the intake shaft 14, and the nozzle arm 18. Centrifugal acceleration of the fluid spreads the fluid into a thin layer that spirals to an exit port 40, exiting the rotor 30 into an outlet passage 42 in an output shaft 44. Centrifugal force exerted by the circulating fluid against the rotor 30 increases drag and improves energy transfer. The outlet passage 42 conducts the fluid to a low-pressure port 46 that exhausts low-pressure fluid from the turbine. The outlet passage 42 typically has a larger diameter than the inlet passage 16.

The taper of the cone 34 increases force and resulting drag between the fluid and the cone 34 as energy-depleted fluid moves toward the exit port 40, further improving overall transfer efficiency. Addition of a cylinder 32 provides increased surface area for energy transfer and increased torque. Additionally, for a fluid that undergoes a phase change, a cylinder 32 provides increased surface area to effect heat transfer, expansion, and cooling. Smooth inner surfaces within the cylinder 32, cone 34, and end cap 31 improve transfer efficiency by promoting laminar flow. Energy transfer may be effected whenever fluid ejected from the nozzle 19 moves faster than the inner surface 35. An inner surface 35 of larger diameter produces higher torque.

Alternate embodiments may include multiple nozzles having adjustments that allow changes in the direction and flow of working fluids. Although the cone 34 may generally have a pitch of 1:1, the pitch, length, and diameter of the cone 34 may vary depending upon velocity and viscosity of the working fluid. The pitch may change at a point where the working fluid changes phase. The cone may be concave or convex.

Depending on the application, the intake shaft 14 may be secured by a variety of known means to a variety of structures. In FIG. 1 the inner race 22 of a bearing 20 is mounted on the intake shaft 14 with a press fit or other means known in the art. The nozzle arm 18 may be attached to the intake shaft 14 by threaded connectors, brazing, or other means known in the art. The outer race 23 of the bearing 20 is secured by a housing 24, which is in turn secured to the end cap 31 by machine screws 25 or other suitable fasteners as are known in the art. In alternate embodiments, the intake shaft 14 may be supported by additional bearings or bushings (not shown), or the rotor 30 may roll directly against low-friction bearing surfaces (not shown).

Returning to the embodiment of FIG. 1, the output shaft 44 may be attached to the cone 34 by a threaded connection, an adhesive, welding, brazing, or by other known means. The attachment may be reinforced by a locking ring 50 affixed to the output shaft 44 by a set screw 52 or other known means. In one embodiment, a key slot 54 in the output shaft 44 may facilitate power transfer from the turbine to a pulley or other known means. In alternate embodiments, the output shaft 44 may be supported by one or more bearings or bushings (not shown).

The turbine described above combines the functions of a turbine housing and rotor to provide a highly simplified means to convert energy within a fluid into rotational energy. This turbine has few moving parts, a high power-to-weight ratio, and can be utilized in applications including automobiles, generators, farm equipment, air tools, industrial steam power plants, and hydroelectric plants. Gas or liquid-phase fluids having a wide range of temperatures and pressures may be utilized as energy sources with few or no modifications to the turbine. The dimensions of a cylinder and cone may be selected to improve energy transfer efficiency with a particular fluid. However, the absence of blades or closely-spaced rotors makes this design tolerant of a wide range of fluid viscosities and contaminants. This turbine may be easily fabricated from metal, plastic, ceramics, glass, and other known materials to accommodate corrosive or superheated fluids. Acceptable balance may be achieved simply by welding, gluing, or otherwise attaching balance weights. Precision manufacturing is not necessary to achieve efficiency or reliability.

Mechanical power may be extracted from this turbine by tools attached directly to the output shaft, such as a grinding wheel or drill chuck; by pulleys, belts, or gears; or by a friction or fluid clutch. In alternate embodiments, permanent magnets or electrical rotor coils mounted on or embedded in the rotor 30 can produce electrical power from stationary coils in a generator or alternator. Flywheels may smooth response to changing load conditions.

A simple embodiment may be constructed from a 4" diameter polyvinyl chloride (PVC) pipe with a PVC end cap on one end and a four-to-two-inch PVC reducer on the other end. A ¾" pipe and bearings are mounted on the cap end. A length of ¼" copper tubing passes through the ¾" pipe to the interior of the 4" PVC pipe. The copper tubing is bent 90 degrees with respect to the ¾" pipe, then bent again along a tangent to the inner wall of the 4" PVC pipe. The ¼" copper tube is crimped to form a nozzle. The four-to-two-inch PVC reducer is attached to the 4" PVC pipe. The ¾" pipe is mounted to a stationary surface. 90 psi air pressure applied to the ¾" pipe forces the turbine to rotate at a rate of about 3400 RPM. 25 psi water pressure causes the same turbine to rotate at a rate of about 2500 RPM.

With a modified nozzle the same turbine design may be reconfigured to function as a pump. The high-velocity nozzle 19 may be replaced with the collector 60 shown in a plan view in FIG. 3. The collector would typically be installed the with flat side 62 close to the inner surface 35 of the rotor 30.

A small quantity of fluid must initially be present within the rotor 30. This condition can be created by immersing the rotor 30 in a fluid reservoir (not shown) or otherwise priming the rotor 30. The low-pressure port 46 remains in direct communication with the fluid reservoir either by immersion or through a siphon (not shown). Torque is applied to either the intake shaft 14 or the output shaft 44 so that the rotor 30 spins in a direction that drags fluid against the open end of the collector 60. Fluid is driven into the collector 60 and exhausted from the high-pressure port 12, lowering the pressure within the rotor 30 and drawing fluid into the low-pressure port 46. In this mode, the roles of intake shaft 14 and output shaft 44 are reversed.

The principles, embodiments, and modes of operation of the turbine have been set forth in the foregoing specification. The embodiments disclosed herein should be interpreted as illustrating the turbine invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the specification.

I claim:

1. A turbine, comprising:

a rotor, the rotor comprising a hollow cone and an end cap, the end cap attached to the base of the cone, the cone having an inner surface;

a bearing, the bearing having an outer race and an inner race, the outer race mounted on the end cap;

an intake shaft, the intake shaft mounted within the inner race, the intake shaft having an inlet passage;

a nozzle arm, the nozzle arm having a first end and a second end, the first end of the nozzle arm connected to the intake shaft, the nozzle arm further having an internal passage communicating with the inlet passage;

a first nozzle, the first nozzle mounted on the second end of the nozzle arm, the first nozzle communicating with the internal passage and oriented to direct a stream of fluid substantially tangentially against the inner surface; and an output shaft, the output shaft mounted on the apex of the cone and parallel to the axis of the cone, the output shaft having an outlet passage, the outlet passage communicating with the interior of the cone.

2. A turbine as claimed in claim 1, wherein a pressurized fluid is introduced into the inlet passage, the fluid issuing from the first nozzle and causing the rotor to rotate.

3. A turbine as claimed in claim 2, wherein the pitch of the cone is selected to optimize energy transfer from the fluid to the rotor.

4. A turbine as claimed in claim 2, wherein motion of the rotor causes an electrical rotor coil to rotate about the axis of the rotor.

5. A turbine as claimed in claim 1, wherein a pressurized fluid selected from the group consisting of water, steam, combustion products, air, and refrigerant is introduced into the inlet passage, the fluid issuing from the first nozzle and causing the rotor to rotate.

6. A turbine as claimed in claim 1, wherein the output shaft further comprises means for attaching a rotating tool.

7. A turbine as claimed in claim 1, wherein the output shaft further comprises means for transmitting mechanical power.

8. A turbine as claimed in claim 1, wherein the first nozzle is adjustable.

9. A turbine, comprising:

a rotor, the rotor comprising a hollow cone, a cylinder, and an end cap, a proximal end of the cylinder attached to the base of the cone, the end cap attached to a distal end of the cylinder, the cone, cylinder, and end cap having an inner rotor surface;

a bearing, the bearing having an outer race and an inner race, the outer race mounted on the end cap;

an intake shaft, the intake shaft mounted within the inner race, the intake shaft having an inlet passage;

a nozzle arm, the nozzle arm having a first end and a second end, the first end of the nozzle arm connected to the intake shaft, the nozzle arm further having an internal passage communicating with the inlet passage;

a first nozzle, the first nozzle mounted on the second end of the nozzle arm, the first nozzle communicating with the internal passage and oriented to direct a stream of fluid substantially tangentially against the inner rotor surface; and an output shaft, the output shaft mounted on the apex of the cone and parallel to the axis of the cone, the output shaft having an outlet passage, the outlet passage communicating with the interior of the cone.

10. A turbine as claimed in claim 9, wherein a pressurized fluid is introduced into the inlet passage, the fluid issuing from the first nozzle and causing the rotor to rotate.

11. A turbine as claimed in claim 10, wherein the pitch of the cone is selected to optimize energy transfer from the fluid to the rotor.

12. A turbine as claimed in claim 10, wherein the pitch of the cone changes at a point where the fluid changes phase.

13. A turbine as claimed in claim 10, wherein the length of the cylinder is selected to facilitate phase change in the fluid.

14. A turbine as claimed in claim 10, wherein motion of the rotor causes an electrical rotor coil to rotate about the axis of the rotor.

15. A turbine as claimed in claim 9, wherein a pressurized fluid selected from the group consisting of water, steam, combustion products, air, and refrigerant is introduced into the inlet passage, the fluid issuing from the first nozzle and causing the rotor to rotate.

16. A turbine as claimed in claim 9, wherein a plane passing through and parallel to the axis of the cone and intersecting the surface of the cone creates lines of intersection with the surface of the cone that are convex with respect to the axis of the cone.

17. A turbine as claimed in claim 9, wherein a plane passing through and parallel to the axis of the cone and intersecting the surface of the cone creates lines of intersection with the surface of the cone that are concave with respect to the axis of the cone.

18. A turbine as claimed in claim 9, wherein the output shaft further comprises means for attaching a rotating tool.

19. A turbine as claimed in claim 9, wherein the output shaft further comprises means for transmitting mechanical power.

20. A turbine as claimed in claim 9, wherein the first nozzle is adjustable.

21. A pump, comprising:

a rotor, the rotor comprising a hollow cone and an end cap, the end cap attached to the base of the cone, the cone having an inner surface;

a bearing, the bearing having an outer race and an inner race, the outer race mounted on the end cap;

an outlet shaft, the outlet shaft mounted within the inner race, the outlet shaft having an outlet passage;

a collector arm, the collector arm having a first end and a second end, the first end of the collector arm connected to the outlet shaft, the collector arm further having an internal passage communicating with the outlet passage;

a collector, the collector mounted on the second end of the collector arm, the collector communicating with the internal passage and oriented to collect fluid disposed against the inner surface; and an intake shaft, the intake shaft mounted on the apex of the cone and parallel to the axis of the cone, the intake shaft having an intake passage, the intake passage communicating with the interior of the cone.

22. A turbine, comprising:

a rotor, the rotor comprising a hollow cone and an end cap, the end cap attached to the base of the cone, the cone having an inner surface which is substantially devoid of any protrusions along the inner surface;

a bearing, the bearing having an outer race and an inner race, the outer race mounted on the end cap;

an intake shaft, the intake shaft mounted within the inner race, the intake shaft having an inlet passage;

a nozzle arm, the nozzle arm having a first end and a second end, the first end of the nozzle arm connected to the intake shaft, the nozzle arm further having an internal passage communicating with the inlet passage;

a first nozzle, the first nozzle mounted on the second end of the nozzle arm, the first nozzle communicating with the internal passage and oriented to direct a stream of fluid substantially tangentially against the inner surface;

the stream of fluid flowing directly against the inner surface to cause rotational acceleration of the rotor and;

an output shaft, the output shaft mounted on the apex of the cone and parallel to the axis of the cone, the output shaft having an outlet passage, the outlet passage communicating with the interior of the cone.

23. A turbine as claimed in claim 22, wherein the connection means of the nozzle arm to the intake shaft comprises the use of threaded connectors or brazing.

* * * * *